United States Patent [19]

Taylor

[11] Patent Number: 4,825,496

[45] Date of Patent: May 2, 1989

[54] CLEANING APPARATUS

[76] Inventor: John Taylor, 21 High Moor, Amersham, Buckinghamshire, United Kingdom

[21] Appl. No.: 178,173

[22] Filed: Apr. 6, 1988

[30] Foreign Application Priority Data

Apr. 7, 1987 [GB] United Kingdom .....8708303

[51] Int. Cl.[4] ..... A46B 13/04

[52] U.S. Cl. ..... 15/24; 15/103

[58] Field of Search ..... 15/23, 24, 28, 29, 97.1, 15/103

[56] References Cited

U.S. PATENT DOCUMENTS

| | | | |
|---|---|---|---|
| 2,222,513 | 11/1940 | Mulvancey | 15/24 |
| 2,682,067 | 6/1954 | Coleman | 15/29 |
| 2,918,685 | 12/1959 | Sundstrom | 15/23 |
| 3,138,815 | 6/1964 | James, Jr. | 15/24 |

FOREIGN PATENT DOCUMENTS

| | | | |
|---|---|---|---|
| 97440 | 7/1924 | Austria | 15/23 |
| 633871 | 2/1962 | Italy | 15/24 |
| 109079 | 2/1925 | Switzerland | 15/23 |
| 420259 | 11/1934 | United Kingdom | 15/29 |

*Primary Examiner*—Edward L. Roberts
*Attorney, Agent, or Firm*—Neal J. Mosely

[57] ABSTRACT

A wheeled trolley (11,12) supports a removable back-pack unit (35,36) containing a motor drive (37,39) and a fluid pump (38). The motor (37) drives the pump (38) to draw fluid from a canister (32) and supply the fluid via flexible hoses (62,63, 64, 65) to a rotary brush unit (57,58,59). The motor rotates the brush via a flexible drive line (61) running from an output (39) on the back-pack to an input (56) on the brush handle (57). The trolley body (11) and back-pack casing (35) co-operate to retain the back-pack on the trolley in a readily removable manner. The canister (32) is likewise readily removable. The fluid supply and the motor electrical supply both run independently of the trolley. The back-pack can therefore be used as such, at locations remote from the trolley, or can remain on the trolley to function as a power pack for the apparatus. The brush (59) may be a cylindrical brush and two different formats (66,83) are disclosed.

7 Claims, 5 Drawing Sheets

CLEANING APPARATUS

FIELD OF THE INVENTION

The invention relates to cleaning apparatus.

The invention is specially applicable to cleaning apparatus comprising a hand-held motor-driven brush rotating, in use, to spread cleaning fluid on a surface to be cleaned by the brush, and incorporating means to supply the fluid to the brush head.

Cleaning apparatus of the kind defined in the preceding paragraph will be referred to as cleaning apparatus of the kind in question.

BACKGROUND TO THE INVENTION

Cleaning apparatus of the kind in question is already known and is embodied in apparatus currently manufactured by Rotabrush International Limited, a United Kingdom company of Chesham, Buckinghamshire under the trade mark ROTABRUSH. Such apparatus has had considerable commercial success in the United Kingdom and elsewhere for several years.

These successful ROTABRUSH apparatus are ground-standing units. They comprise a wheeled trolley on which are mounted a motor drive and a fluid pump. In use, the pump draws fluid from a fluid canister - which may also be carried on the trolley - and supplies it to the brush head. The motor, preferably a mains-supply-powered electric motor, transmits rotary movement to the brush head via an elongate drive line. And the fluid supply line and the drive line are both sufficiently flexible to allow a user of the apparatus to move the brush about the surface to be cleaned.

Such apparatus works well, but there are circumstances where the essentially ground-standing nature of the apparatus presents drawbacks. For example, a user might want to work high off the ground, from a ladder or scaffold or powered access platform. The known ROTABRUSH apparatus could not be transported (or could be transported only with difficulty) to such locations.

Conversely, any attempt to provide a drive line from the apparatus to such a remote location is either impractical or literally technically impossible. If, as in the case of a powered access platform, the brush-holding operator might move substantial distances over and above the normal arc of sweep of the brush relative to his body, from the ground-standing trolley, an appropriate flexible drive line from trolley-mounted motor to remote brush head might well be ruled out. The need to manhandle a fluid supply line over such a distance, and under such working conditions, might similarly negate the successful working of the apparatus. And the general inconvenience, even danger, of attempting to work with excessively long multiple lines under such conditions is enormously increased.

SUMMARY OF THE INVENTION

The invention takes as its starting point the known ROTABRUSH apparatus discussed above. It sets out to provide an improved version of such apparatus which, unlike the known apparatus, can practically be used at locations which are remote from the trolley and may vary considerably, during a cleaning cycle, in distance and/or height from the ground-standing trolley; whilst retaining the advantages of the known trolley-based design.

In its broadest aspect the invention is embodied in cleaning apparatus characterised by the combination of a) a trolley having means, selected from the group comprising wheels, skids and other ground-engaging members, to facilitate ground travel of the trolley;
b) a back-pack unit incorporating a motor drive;
c) means mounting the back-pack unit on the trolley in a readily releaseable manner;
d) a hand-held brush rotatable, in use, to spread cleaning fluid on a surface to be cleaned by the brush;
e) a pump supplying the cleaning fluid, in use, to the brush head;
f) means mounting the pump on the apparatus; and
g) a drive line from the motor to the brush, and a fluid supply line from the pump to the brush, both said lines being sufficiently flexible to allow a user of the apparatus to move the brush about the surface to be cleaned.

Such a unit has two alternative modes of use. It can be used as a ground-standing unit, just like the existing ROTABRUSH apparatus. Or alternatively the user can take the back-pack unit off the trolley, proceed with it to the location that he wants to clean, and proceed to work with a drive line which need not be increased in length. He has only the back-pack unit to take with him up ladders, onto scaffolds, up in powered access platforms, and the like. And if - as in a presently preferred embodiment of the invention - he also takes with him a portable fluid supply canister, then his fluid supply line needs not be lengthened either. The only extra length of component he may require is the electrical lead line supplying power to the motor if the motor is an electrically-driven one rather than, for example, a small petrol-fuelled internal combustion engine incorporating its own petrol tank.

Preferably the trolley has peripheral walls and portions of these wall are so shaped as to co-operate with complementary portions of the back-pack unit to retain the unit releasably on the trolley. The unit could be retained by such means as readily releaseable clips, but in practise, as the trolley is never likely to be inverted or even drastically up-ended, clips in the traditional sense may be unnecessary. Alternatively, if some form of clipping action is needed, the shaping and complementary inter-engaging of the wall portions and the back-pack portions could combine with modern resilient constructional materials to provide such action.

Preferably also, the walls incorporate compartments in which components of the apparatus - in particular, drive line components - can be stowed. In the known ROTABRUSH units, the drive to the brush head, and the fluid supply line, stow on the unit when the unit is not in use. But they are both coiled and/or rested on top of the trolley unit. The present invention lends itself readily to a construction where these components can be positively stowed within the unit to advantage.

In the case just outlined, some at least of the compartments may comprise tunnels running inboard of the trolley walls. In the embodiment of the invention to be described later in this specification, the cleaning brush has a handle of variable length constructed in a manner, known from the existing ROTABRUSH unit, in which a plurality of linearly elongate tubular drive line arms co-operate one with another in any desired number to form a high-reach handle. Tunnels running inboard of the trolley walls enable these relatively rigid long tubular handle sections to be neatly, safely and unobtrusively stowed on the trolley.

Another advantage of the tunnel compartment construction just outlined is revealed when, in another preferred feature of the invention, portions of the tunnels complement the previously-mentioned shape of the wall portions of the trolley in seating the back-pack unit on the trolley.

In yet another advantageous development of the invention, the trolley walls are preferably so shaped that portions of those walls surround, in use, the fluid canister and retain the canister removably on the trolley. The known ROTABRUSH apparatus has a fluid canister which is carried on the trolley and can readily be removed from it. Hitherto, of course, the primary advantage that this gives - the ability to take the fluid canister and the motor drive and drive line away from the trolley - had not been recognised before the advent of the present invention. But even with the invention now revealed in its broadest aspect, shaping the trolley walls to surround and retain the canister on the trolley brings fruther advantages; for example, a relatively deep boxed well can be formed thereby and, as well as the canister, other components can be housed removably and unobtrusively inside that well.

In any apparatus embodying the invention, the brush may be a cylindrical brush whose bristles emerge generally from the longitudinal axis about which the cylinder, defined by the bristle ends, rotates in use. Cylindrical brushes make it easier to clean pipe lines externally with apparatus of the kind in question. Given the inventive advantage of apparatus embodying the present invention, mainly the ability of the user to work high up where most horizontal pipe runs are positioned, the use of a cylindrical brush is an advantageous and inventive development of the apparatus embodied in the present invention.

REVIEW OF ART KNOWN TO THE APPLICANTS

United Kingdom patent specifications No. 2 017 488 (Riggers Steeple Jacks) shows a window cleaning apparatus which includes a fluid reservoir incorporated into a back-pack unit. There is no suggestion that a motor driven rotating brush may be used, and no directions as to how to do so. And despite the fact that this prior specification was published just before the first of the known ROTABRUSH apparatus was marketed, and has been available to the public throughout the succeeding years of ROTABRUSH success, the teachings of the two have never been combined.

United Kingdom patent specification No. 1 062 393 (Verhogen) shows a motor driven cylindrical brush which rotates, in use, to dislodge soot deposits from the inside wall of boiler fire tubes. There is no suggestion that cleaning fluid may be supplied to the brush head, and no indication that any part of the device may be incorporated into a back-pack unit.

United Kingdom specification Nos. 1 074 900 (Flexible Drives) and 2 159 911 (British Gas) each show drive mechanisms for rotary cleaning tools which may comprise brushes. The mechanism drives the tool using a flexible drive shaft. However, neither the use of a fluid supply nor the use of a back-pack unit with such mechanisms is mentioned.

United Kingdom specification No. 2 061 447 (Andreasen) shows a rotating brush for cleaning the inside wall of shafts or pipes. The brush is driven, in use, by the reaction to the momentum of cleaning fluid, supplied to the surface to be cleaned. No mention is made of incorporating any of this into a back-pack unit and nor is it apparent how it might be modified to function as primarily an exterior surface cleaner.

United Kingdom specifications Nos. 905 423, 1 054 431, and 1 139 037 are known to the applicants as disclosing hand-held cylindrical brushes, in one instance supplied with a fluid feed.

BRIEF DESCRIPTION OF THE ACCOMPANYING DRAWINGS

In the drawings accompanying this description and forming part of this present specification:

FIG. 1 is a three-dimensional view of a presently preferred apparatus embodying the invention, the apparatus being shown viewed from the front and one side;

FIG. 2, again in three dimensions, shows the same apparatus from the front and from its other side;

Figure 11:
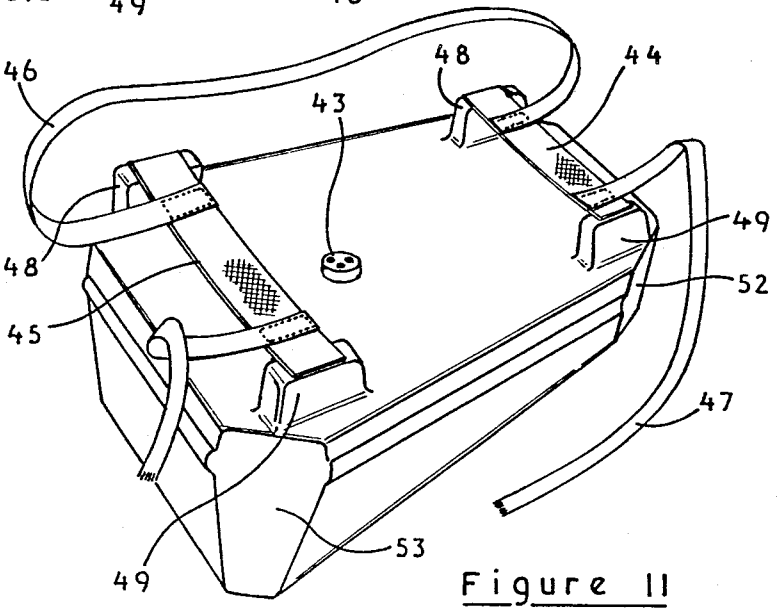
Figure 12:
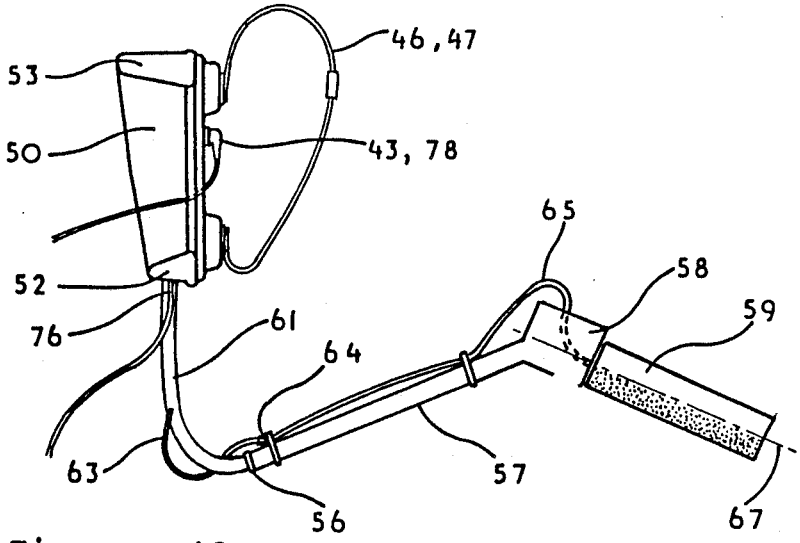
Figure 13:
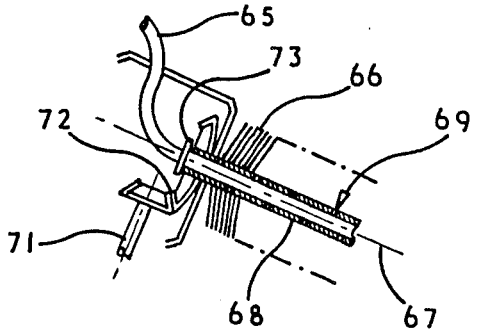

FIGS. 7, 8, 9 and 10 as a group show the back-pack unit of the apparatus in, respectively, side elevation; plan; rear elevation; and front elevation;

FIG. 11 shows the back-pack unit in three-dimensional underplan;

FIG. 12 shows the back-pack unit and its associated components assembled ready for use away from the trolley;

FIG. 13 is a section through part of the brush head of the apparatus; and

Figure 14:
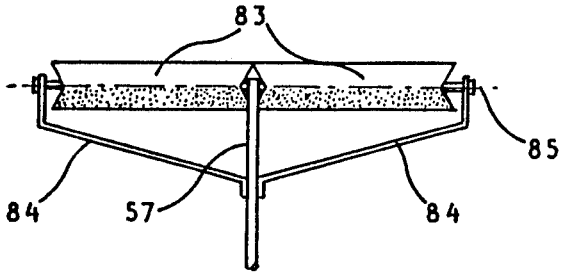

FIG. 14 shows an alternative form of brush to that shown in FIG. 12.

Figure 1:
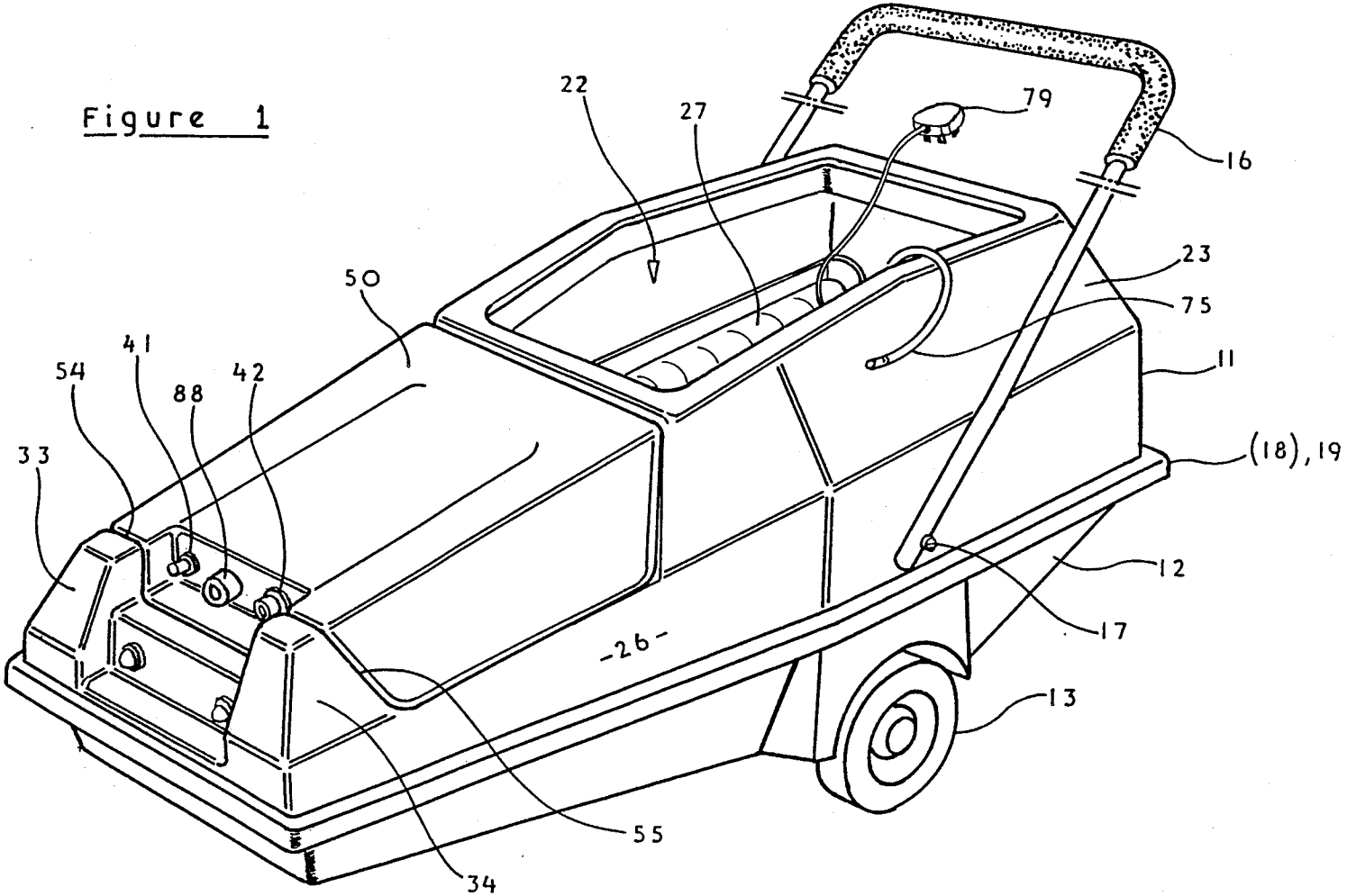
Figures 2, 3:
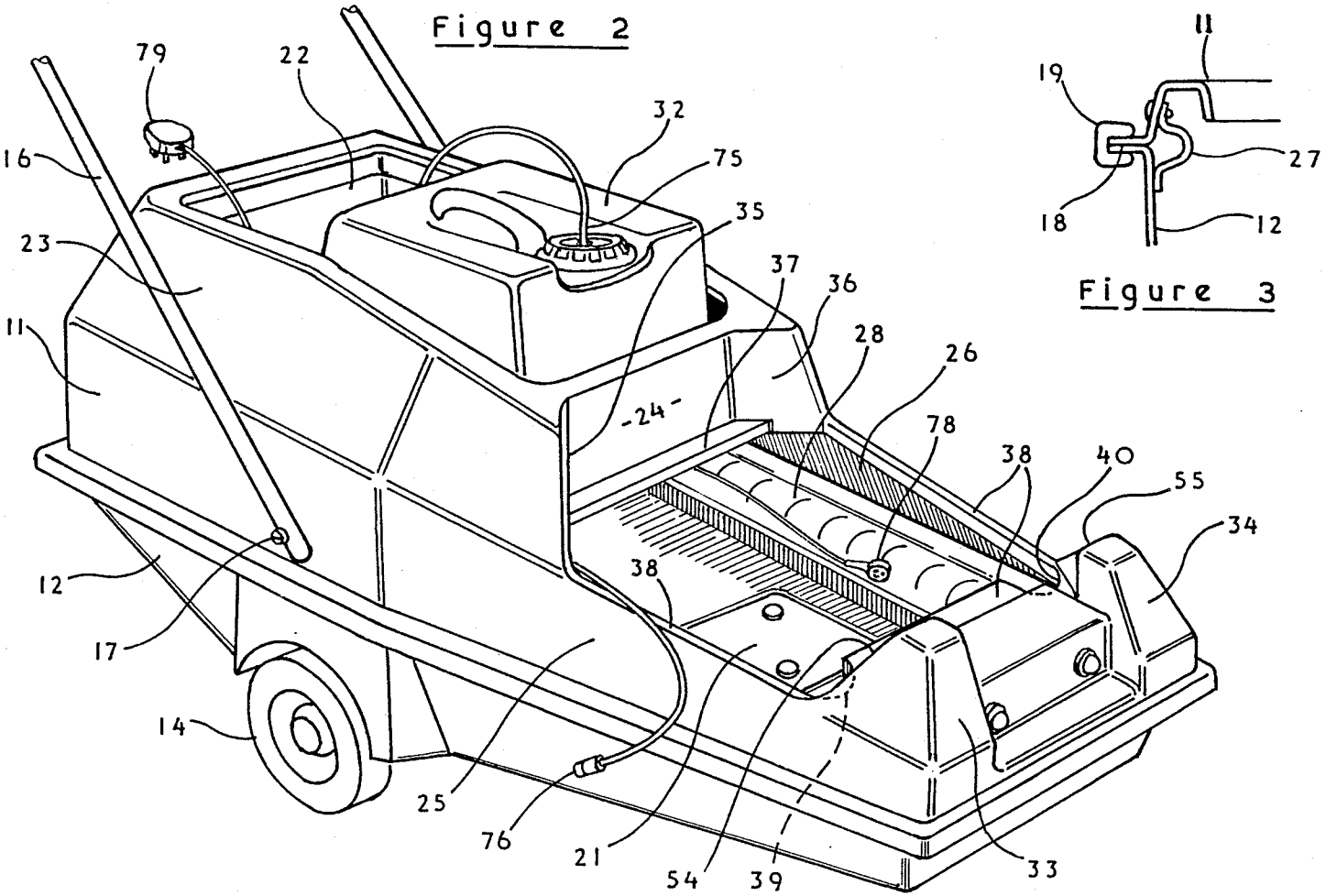
FIG. 3 is a scrap section, taken vertically across the body of the trolley of the apparatus, showing the way the body halves are held together.
Figure 4:
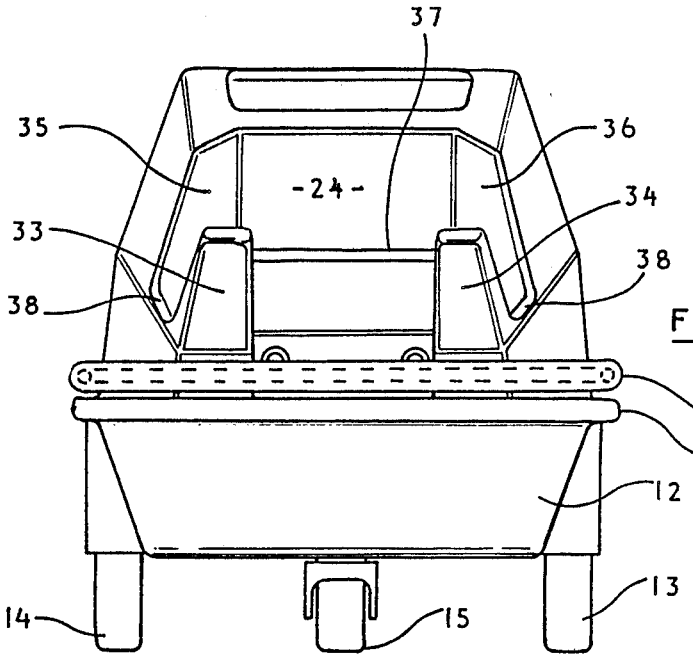
FIG. 4 shows the trolley in front elevation.

In FIG. 1, the back-pack unit is in place on the trolley but the fluid canister has been removed. In FIG. 2, the fluid canister is in place but the back-pack unit has been removed. In FIG. 4, both the back-pack unit and the fluid canister are absent. The canister is absent from FIG. 5. The back-pack unit has had its straps removed, for clarity, from FIGS. 7 through 10; but the straps are deliberately shown in FIG. 11. FIG. 13, like FIG. 3, is drawn to an enlarged scale by comparison with the rest of the drawings.

DESCRIPTION OF THE PREFERRED EMBODIMENT

A wheeled trolley, illustrated principally in FIGS. 1 and 2 of the drawings, comprises a body 11 atop a chassis 12 supported on wheels 13, 14 and 15. The wheels 13 and 14 are mounted in one coaxial pair towards the rear of the trolley. The single wheel 15 is mounted towards the front of the trolley on the longitudinal centre line of the trolley.

All the wheels are freely rotatable about their individual axes of rotation. In addition, the wheel 15 is mounted castor-fashion so that it is freely rotatable about a generally vertical axis when the trolley is in its normally intended attitude of use, standing on the ground, as illustrated in FIGS. 1 and 2.

A U-shaped handle 15 is pivoted at 16, 17 respectively to each opposite side wall of the trolley body 11. The handle 15 swings freely about its pivots 16, 17 between an in-use position shown in FIGS. 1 and 2, and a stowed position.

To move the handle from its in-use position to its stowed position, the handle is swung anti-clockwise (when viewing the trolley as in FIG. 1) until it lies flat against the join flange 18 where the chassis 12 abuts the body 11 of the trolley around the trolley periphery. FIG. 3 shows the construction of this join flange 18 whilst FIG. 4 shows the handle 15 in its stowed position lying flat on top of the flange 18.

The body 11 and chassis 12 of the trolley are each moulded from plastics material to form two relatively rigid boxes. They are each peripherally lipped outward to join along, and define, their common flange 18. A resilient rubber fender 19 clothes the flange 18 around its entire extent. The fender 19 masks the join as well as protecting the moulded body and chassis of the trolley from sideways impact.

The coaxial rear wheels 13 and 14 of the trolley are firmly fixed to the undeside of the chassis 12. The single caster-action front wheel 15 has its caster yoke pivoted to a plate 21 which is itself firmly fixed into a recess moulded into the underside of the chassis 12.

As FIG. 2 shows particularly, the body 12 and chassis 11 when joined define a largely open-topped box of considerable carrying capacity. The well of chassis 12 extends virtually uninterrupted along and across the entire area of the trolley. The open top 22 of a rear, vertically raised, side wall and end wall portion 23 of the body 11 gives almost unimpeded access to the well of the chassis in that region of the trolley. The bulkhead 24 across the trolley which defines the front wall of the raised portion 23 of the body 11, extends down short of the flange 18; and the front portion of the body 11, whilst exhibiting stepped-down walls 25, 26, is again virtually open-topped throughout its entire area.

Tunnels 27, 28 are moulded into a generally U-shape, from the same plastics material as the chassis 12 is moulded from, and are fixed inboard of the side walls of the combined body-chassis 11, 12 to run along the length of the trolley. The tunnels 27 and 28 define, with the inboard regions of the side walls of the body-chassis unit 11, 12, tubular compartments running one along each opposite inboard side of the trolley.

Figure 5:
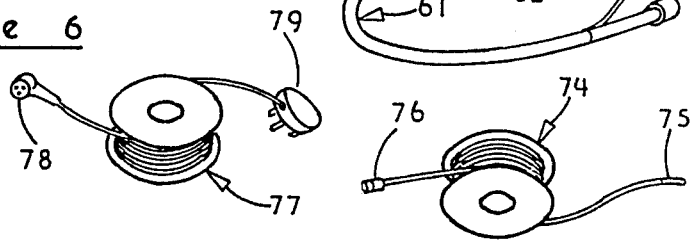
FIG. 5 is a perspective view from the rear of the trolley.
Figure 5:
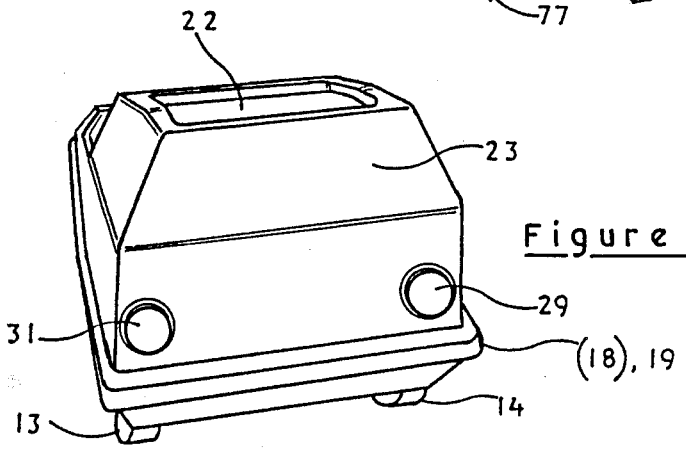
Figure 10:
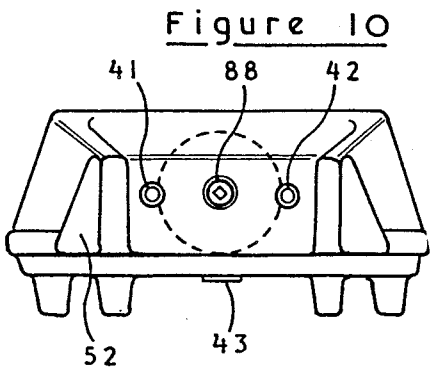
Figure 7:
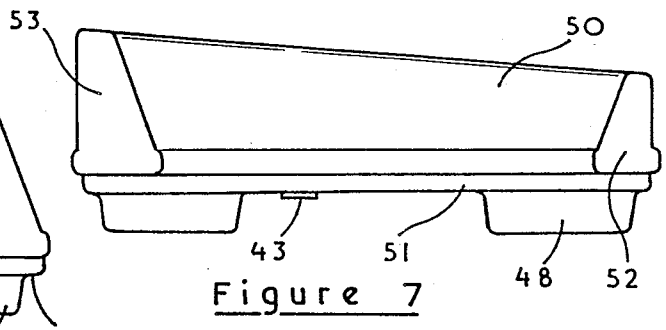
Figure 9:
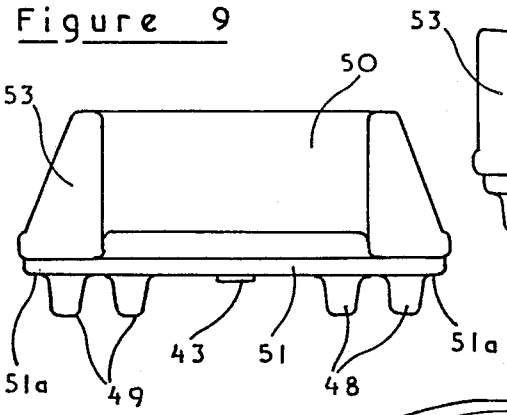

Access to these compartments is given by circular cut-outs 29, 31 in the rear wall of the body 11, as shown in FIG. 5. Although they are thus open-ended at the rear of the trolley, the compartments are closed at the front of the trolley.

A sizable but nevertheless relatively readily portable fluid canister 32, of known kind, sits in the well of the trolley as shown in FIG. 2 to protrude slightly from the opening 22. The bulkhead 24 and the side walls of the raised-wall portion 23 of the body 11, surround the fluid canister 32 and retain it removable on the trolley. The size of the opening 22 relative to the canister 32 is nevertheless such that an appreciable space behind the canister 32 remains, as again FIG. 2 illustrates, unoccupied by the canister.

The front portion of the body moulding 11 of the trolley exhibits raised buttresses 33, 34. The stepped-down side wall portions 25, 26 connect these buttresses to respective flat faces 35 and 36 which blend into the bulkhead 24 of the raisedwall portion 23 of the body moulding 11.

A ledge 37 is stepped out from the bottom edge of the bulkhead 24 to span the gap between the flat faces 35 and 36 and to join, at each of its opposite ends, a respective one of those two flat faces. A similarly sized ledge 38 runs inboard of the body side walls 25 and 26, and across the body between the buttresses 33 and 34, to define a generally U-shaped run of ledge lying in the same plane as the ledge 37.

FIG. 2 shows these details of the ledges 37 and 38. It also shows that, whilst the ledge 38 is continuous around its U-shape, respective cut-outs 39 and 41 are effectively defined in the run of the ledge 38 as it makes the transition from each opposite side run (inboard of a respective one of the walls 25 and 26) to its run across the body between the buttresses 33 and 34.

A back-pack unit used with the trolley consists essentially of a body 50 atop a chassis 51 each moulded, like the body 11 and chassis 12 of the trolley, from plastics material to encase an electric motor 86, one end of whose output shaft drives pump 87 whilst the other end presents a square-section drive output 88 externally of the back-pack casting 50, 51.

Figure 8:
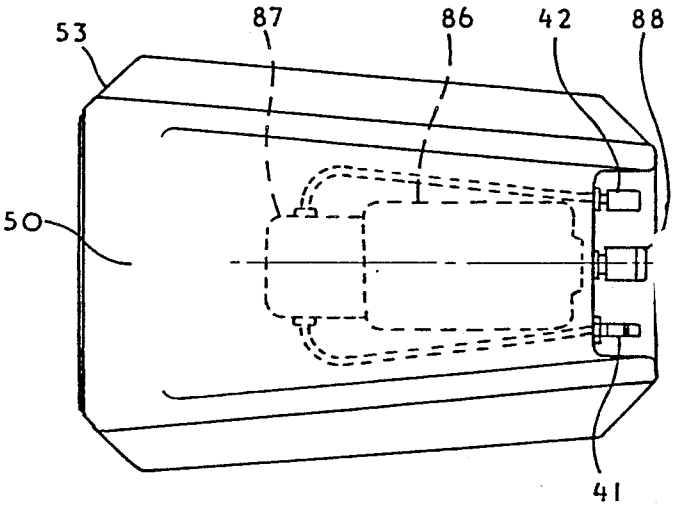

The drive motor 86 and pump 87 are proprietary units. The motor 86 incorporates reduction gearing whose details need not be specified, between its armature and its drive output 88. A fluid entry line 41 and exit supply line 42 run respectfully from positions one on each side of the drive output 88 in the back-pack body 50, inside the body, to and from the pump 87 as illustrated in FIG. 8.

An electrical socket 43 projects from the underside of the back-pack chassis 51 to enable a power supply to the motor 86. Padded bearer straps 44, 45 span the underside of the chassis 51 to seat, in use, in the small of the back of a normally proportioned man. Adjustable-length straps 46, 47 enable the back-pack to be worn as such in an attitude, illustrated in FIG. 12, in which the drive output 88 points vertically downward when the user is standing normally erect.

As FIG. 1 shows, the back-pack is so shaped and sized as to sit on the trolley in one mode of use of the apparatus. When seated in place on the trolley, as illustrated in FIG. 1, the peripheral region 51 of the underside of the back-pack chassis 51 sits on the ledges 37 and 38 of the trolley body 11; the opposite-side feet 48 and 49 of the back-pack chassis 51 rest on the tops of the tunnels 28 and 27 respectively; and the flat angled surfaces 52 at the front and 53 at the rear of the back-pack body 50 abut the complementary surfaces 54, 55 and 35, 36 respectively of the trolley body 11 to retain the back-pack releaseably on the trolley.

To remove the back-pack from the trolley, i.e. to go from the apparatus illustrated in FIG. 1 to that shown in FIG. 2, it is only necessary to lift the back-pack vertically. When the back-pack is subsequently replaced, the front-end sections of its feet 48 and 49 (i.e those sections adjacent the shaped surface 52 of the back-pack body) descent into the cut-outs 39 and 41 bordered by the ledge 38 of the trolley body 11. The opposite-side runs of the ledge 38 locate the back-pack laterally whilst the surfaces 54 and 55 (at the front) and 35 and 36 (at the rear) locate the back-pack longitudinally in the trolley body 11.

A sheathed flexible drive, known from the existing ROTABRUSH apparatus previously discussed, quick-couples at one end to the motor drive output 88 and at the other end to the input 56 of a tubular handle 57 supporting a brush head 58 in which a cylindrical brush 59 is rotatably journalled. The sheathed flexible drive is referenced 61 in FIG. 6 from which it will be seen also that the pposite ends of a fluid supply line referenced respectively 62 and 63 protrude from the sheath adjacent the quick-couplings on the respective ends of the drive 61; and these fluid supply line ends themselves carry quick-coupling units of appropriate kind, one to meet with the end 42 of the fluid supply line from the pump 87 of the back-pack unit, the other to couple to an end 64 of a length of fluid supply line 65 running along the handle 57 and into the head 58 of the rotary brush unit.

The brush 59 of the brush unit is a cylindrical brush whose bristles 66 emerge generally from the longitudinal axis 67 of rotation of the brush. The bristles 66 are all substantially the same protruding length so that the envelope of the bristleends defines the cylindrical surface of the brush. The shaft 68 from which the bristles 66 protrude is perforated, as indicated at 69 in FIG. 13, and is tubular.

The essentially rigid rotary drive shaft 71 which extends up the handle 57 of the brush unit drives the tubular brush core shaft 68 through angled bevel gears 72. The fluid supply line 65 enters the brush head 58 and feeds the brush core shaft 68 through a fluid-tight coupling 73 which allows the brush to rotate relative to the non-rotatiing supply line 65.

The skilled addressee of this specification will be able to supply these details without inventive thought; they are known in themselves from the known ROTABRUSH apparatus;

An on-off switch for the motor 86, and a valve to cause cleaning fluid to flow on demand from the pump 87, are mounted on the handle 57 of the brush unit and are linked by appropriately flexible lines to the motor and to the pump respectively. Neither of these user-operated controls is shown in the drawings and their details form no essential feature of the invention embodied in the apparatus illustrated.

To use the apparatus with the back-pack in place on the trolley, as illustrated in FIG. 1, the fluid canister 32 is filled and is stood in the well of the trolley in its FIG. 2 illustrated position. A reel 74 (FIG. 6) of fluid supply hose is stowed in the well of the trolley in the space behind the canister 32. One end 75 of this hose dips below the level of fluid in the canister 32. The other end 76 is quick-coupled to the inlet 41 on the back-pack.

A reel 77 (FIG. 6) of electrical power supplying cable is also stowed in the trolley behind the canister 32. A plug 78 on one end of the cable plugs into the electrical socket 43 on the underside of the back-pack chassis 51. Another and appropriately fused and circuit-protected plug 79 on the other end of the electrical supply cable 77 plugs into a mains supply (not shown) socket in the vicinity of the apparatus.

The flexible drive line 61 is coupled at one end to the back-pack drive output 88 and at its other end to the brush handle drive input 56. The fluid supply hose end 63 on the drive line 61 is coupled to the hose end 64 on the brush unit handle 57, and the other end at 62 of the drive line fluid hose is coupled to the fluid output 42 on the back-pack.

In use, and in a manner already known from the ROTABRUSH apparatus previously referrred to, the motor drives the pump to draw fluid from the canister whilst simultaneously driving the flexible drive line to rotate the brush. Fluid entering the brush head along the axis of rotation of the brush is spread by centrifugal force to the bristle-ends of the rotating brush and hence to the surface to be cleaned by the brush. It is not necessary for the fluid to be supplied at high pressure by the pump to the brush. Nor is it essential for the fluid to be supplied constantly as the brush rotates.

To use the back-pack unit at a location remote from the trolley, the canister 32 is lifted our of the trolley and is transported with the back-pack and the brush unit to the desired location. The hose reel 74 and electrical reel 77 leave the trolley with the back-pack unit and travel with that unit to the location. They remain coupled to the back-pack unit in use, as does the drive line 61 and its fluid hose 62, 63. The hose 74 dips via its end 75 into the canister 32 as before, and the plug 79 on the end of the electrical cable 77 supplies electrical power to the back-pack unit just as it previously did. The cable reel 77 can be unwound as far as is necessary to distance the back-pack unit from the source of electrical supply into which the plug 79 is fitted. The canister 32 can either stay close by the back-pack unit or, if feasible, the hose 74 can progressively unwind to accommodate the movement of the back-pack unit from the canister 32 at and around the working location.

Figure 6:
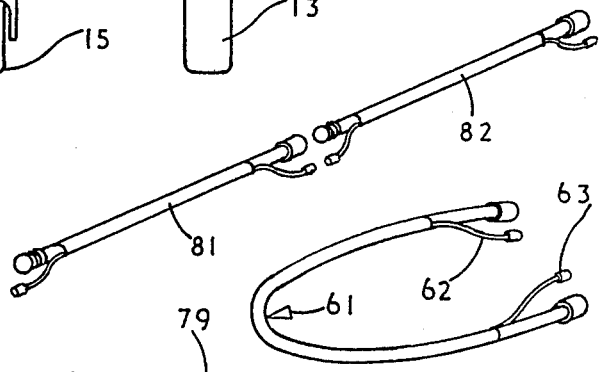
FIG. 6 is a group of sketches showing drive, fluid, and power supplying components of the apparatus.

The drive line 61, as shown in FIG. 6, is not so flexible that it can be coiled into a reel. It is generally U-shaped when not in use. It can therefore be stowed in the well of the trolley, with each of its opposite ends below the back-pack 50 and with its U-section running around the back of the canister 32.

Spare brush heads, tools, or other equipment can all be stowed in the well of the trolley together with the drive line 61, hose reel 74, electrical cable reel 77 and coiled drive line 61 even though the canister 32 is also in place in the trolley.

Extension drive line "poles" 81 and 82 which may be supplied with the apparatus, can also be stowed, one in each of the tunnels 27 and 28 running inboard along the trolley side walls. The construction and operation of these drive line extension poles is known from the known ROTABRUSH apparatus, as well as being self-evident in the context of this specification. With all these components on board, and with the handle 15 stowed against the trolley join 18, the apparatus is exceptionally compact and unobtrusive yet accommodates everything necessary for both alternative modes of use.

The brush head shown in FIG. 14 is driven in a manner similar to that illustrated in FIGS. 12 and 13, by bevel gears which in this instance drive through a right-angle. Two identical cylindrical brushes each referenced 83 project along a common rotational axis from the brush head. Arms 84 support the projecting brushes 83 each of which rotates in the same direction about its common axis 85.

As FIG. 4 shown, the brush bristles are splayed so that a substantially continuous bristled envelope contacts the surface to be cleaned. The fact that the bristles have to push their way past the top end of the handle 57 in this construction is of less importance than the need to present a continuous bristle envelope to the surface to be cleaned.

Throughout this specification, the term "brush" is intended to be functionally definitive in scope. It embodies any implement having a surface-brushing action imparted by a plurality of bristle-equivalent members projecting from the axis about which the "brush" rotates. Thus, for example, a plurality of paddle-like members could project from the axis of the brush head, each having a scraping action on the surface to be cleaned as they rotate.

I claim:

1. Cleaning apparatus characterised by the combination of (a) a trolley having means, selected from the group comprising wheels, skids and other ground-engaging members, to facilitate ground travel of the trolley;

(b) a back-pack unit incorporating a motor drive;

(c) means mounting the back-pack unit on the trolley in a readily releasable manner;

(d) a hand-held brush rotatable, in use, to spread cleaning fluid on a surface to be cleaned by the brush;

(e) a pump supplying the cleaning fluid, in use, to the brush head;

(f) means mounting the pump on the apparatus; and (g) a drive line from the motor to the brush, and a fluid supply line from the pump to the brush, both said lines being sufficiently flexible to allow a user of the apparatus to move the brush about the surface to be cleaned.

2. Cleaning apparatus according to claim 1 and characterised by the features that the trolley has peripheral walls and that portions of these walls are so shaped as to co-operate with complementary portions of the back-pack unit to retain the unit releasably on the trolley.

3. Cleaning apparatus according to claim 2 and characterised by the feature that the walls incorporate compartments in which components of the apparatus, in particular, drive line components, can be stowed.

4. Cleaning apparatus according to claim 3 and characterised by the feature that the compartments tunnels running inboard of the walls.

5. Cleaning apparatus accoridng to claim 4 and characterised by the feature that portions of the tunnels complement the said shaped wall portions in seating the back-pack unit on the trolley.

6. Cleaning apparatus according to claim 2 and characterised by the feature that portions of the walls are so shaped as to surround, in use, a fluid canister and retain the canister removably on the trolley.

7. Cleaning apparatus according to claim 1 and characterised by the feature that the brush is a cylindrical brush whose bristles emerge generally from the longitudinal axis about which the cylinder, defined by the bristle-ends, rotates in use.

* * * * *